US006945493B1

(12) United States Patent
Gottesman

(10) Patent No.: US 6,945,493 B1
(45) Date of Patent: Sep. 20, 2005

(54) DUAL TOILET PAPER HOLDER SYSTEM

(76) Inventor: Elaine Gottesman, 8325 112 St. North, Apt. #110, Seminole, FL (US) 33772

( * ) Notice: Subject to any disclaimer, the term of this patent is extended or adjusted under 35 U.S.C. 154(b) by 97 days.

(21) Appl. No.: 10/630,152

(22) Filed: Jul. 30, 2003

(51) Int. Cl.[7] ..... B65H 75/22
(52) U.S. Cl. ..... 242/594.5; 242/560.2
(58) Field of Search ..... 242/594, 594.2, 242/594.4, 594.5, 594.6, 598.4, 598, 599.2, 242/560, 560.2; D5/518, 520, 523; 248/309.2, 248/905

(56) References Cited

U.S. PATENT DOCUMENTS 2,790,608 A * 4/1957 Sieven ..... 242/560
3,297,265 A * 1/1967 Turro ..... 242/599.1
3,830,198 A * 8/1974 Boone ..... 242/560
3,837,595 A * 9/1974 Boone ..... 242/594.5
D252,842 S * 9/1979 McKee ..... D6/523
4,834,316 A * 5/1989 DeLorean ..... 242/594.5
D406,481 S * 3/1999 Conrado ..... D6/520
6,378,800 B1 * 4/2002 Apichom ..... 242/560
6,460,799 B1 * 10/2002 Ryan ..... 242/594.5
D482,916 S * 12/2003 Smurlick et al. ..... D6/518

* cited by examiner

*Primary Examiner*—William A. Rivera
(74) *Attorney, Agent, or Firm*—Edward P. Dutkiewicz

(57) ABSTRACT

Each of a pair of secondary spindle support holders has an upper end with an upper aperture adapted to receive there through a primary spindle. Each support holder has an intermediate aperture adapted to receive and support a secondary spindle for supporting a secondary roll of toilet paper. A lower cross bar and an intermediate cross bar are coupled to the support holders.

1 Claim, 3 Drawing Sheets

DUAL TOILET PAPER HOLDER SYSTEM

BACKGROUND OF THE INVENTION

1. Field of the Invention

The present invention relates to a dual toilet paper holder system and more particularly pertains to supporting a secondary roll of toilet paper in a safe and convenient manner.

2. Description of the Prior Art

The use of toilet paper holders of known designs and configurations is known in the prior art. More specifically, toilet paper holders of known designs and configurations previously devised and utilized for the purpose of supporting a secondary roll of toilet paper are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,830,198 issued Aug. 20, 1974, to Boone discloses a device for providing treated sheet-like materials. U.S. Pat. No. 4,834,316 issued May 30, 1989, to DeLorean discloses an Auxiliary Bathroom Tissue Dispenser. U.S. Pat. No. 6,460,799 issued Oct. 8, 2002, to Ryan discloses a toilet paper holding device. U.S. Pat. No. Des. 356,225 issued Mar. 14, 1995, to Coggins et al. discloses a single, spare toilet paper roll holders. Finally, U.S. Pat. No. Des. 406,481 issued Mar. 9, 1999, to Conrado discloses a hanger for second toilet paper roll.

While these devices fulfill their respective, particular objectives and requirements, the aforementioned patents do not describe a dual toilet paper holder system that allows supporting a secondary roll of toilet paper in a safe and convenient manner.

In this respect, the dual toilet paper holder system according to the present invention substantially departs from the conventional concepts and designs of the prior art, and in doing so provides an apparatus primarily developed for the purpose of supporting a secondary roll of toilet paper in a safe and convenient manner.

Therefore, it can be appreciated that there exists a continuing need for a new and improved dual toilet paper holder system which can be used for supporting a secondary roll of toilet paper in a safe and convenient manner. In this regard, the present invention substantially fulfills this need.

SUMMARY OF THE INVENTION

In view of the foregoing disadvantages inherent in the known types of toilet paper holders of known designs and configurations now present in the prior art, the present invention provides an improved dual toilet paper holder system. As such, the general purpose of the present invention, which will be described subsequently in greater detail, is to provide a new and improved dual toilet paper holder system and method which has all the advantages of the prior art and none of the disadvantages.

To attain this, the present invention essentially comprises a dual toilet paper holder system for supporting a secondary roll of toilet paper. The supporting is done by a primary spindle supported on a primary spindle support while holding a primary roll of toilet paper.

A secondary spindle is provided for supporting a secondary roll of toilet paper parallel with, but spaced beneath, a primary spindle and primary toilet paper roll. The secondary spindle is axially adjustable to allow convenient coupling and uncoupling with respect to the system for mounting of a new roll of toilet paper.

Next provided is a pair of secondary spindle support holders. Each of the support holders has an upper end with a large aperture adapted to receive there through a primary spindle. Each of the support holders has an intermediate aperture of a reduced size adapted to receive and support a secondary roll of toilet paper. Each of the support holders has a lower slot beneath the intermediate aperture and an intermediate slot between the upper and intermediate apertures.

A pair of cross bars is provided next. Included in the pair of cross bars is a lower cross bar with opposed ends formed with inverted U-shaped recesses received in the lower slot of the support holders. The cross bars also include an intermediate cross bar. The intermediate cross bar has inverted U-shaped recesses received in the intermediate slots of the support holders. The support holders are spaced a fixed distance below the secondary spindle by the lower cross bar in association with the lower apertures and the support holders are spaced a fixed distance above the secondary spindle by the intermediate cross bar in association with the lower apertures. The support holders and cross bars are fabricated of an essentially rigid plastic material.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dual toilet paper holder system which has all of the advantages of the prior art toilet paper holders of known designs and configurations and none of the disadvantages.

It is another object of the present invention to provide a new and improved dual toilet paper holder system which may be easily and efficiently manufactured and marketed.

It is further an object of the present invention to provide a new and improved dual toilet paper holder system which is of durable and reliable constructions.

An even further object of the present invention is to provide a new and improved dual toilet paper holder system which is susceptible of a low cost of manufacture with regard to both materials and labor, and which accordingly is then susceptible of low prices of sale to the consuming public, thereby making such dual toilet paper holder system economically available to the buying public.

Even still another object of the present invention is to provide a dual toilet paper holder system for supporting a secondary roll of toilet paper in a safe and convenient manner.

Lastly, it is an object of the present invention to provide a new and improved dual toilet paper holder system having a pair of secondary spindle support holders each with an upper end with an upper aperture adapted to receive there through a primary spindle. Each support holder has an intermediate aperture adapted to receive and support a secondary spindle for supporting a secondary roll of toilet paper. A lower cross bar and an intermediate cross bar are coupled to the support holders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is herein illustrated the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
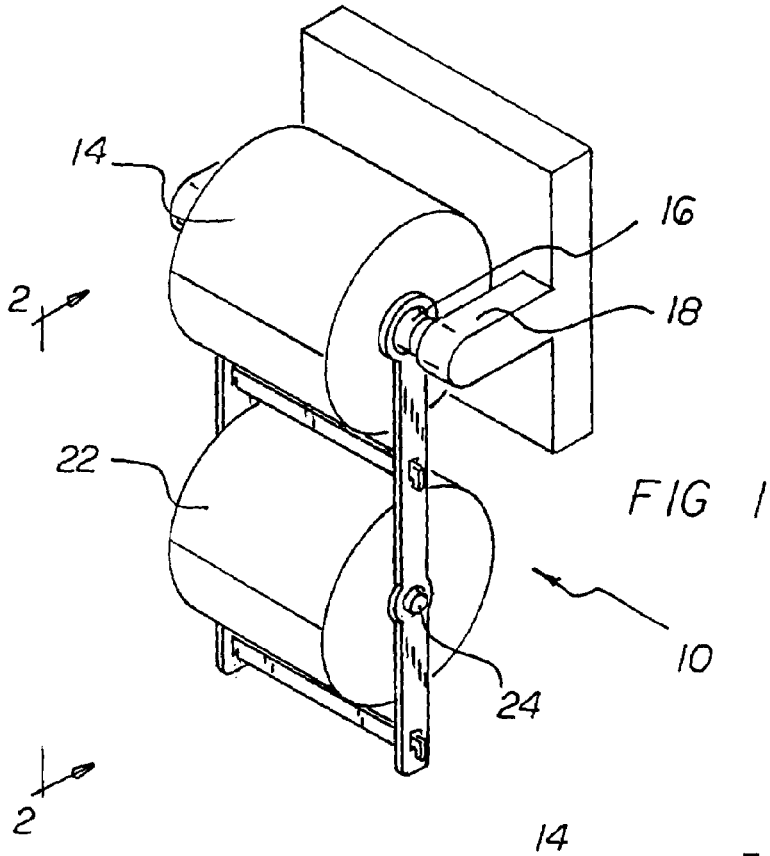
FIG. 1 is a perspective illustration of the dual toilet paper holder system constructed in accordance with the primary embodiment of the present invention.
Figure 2:
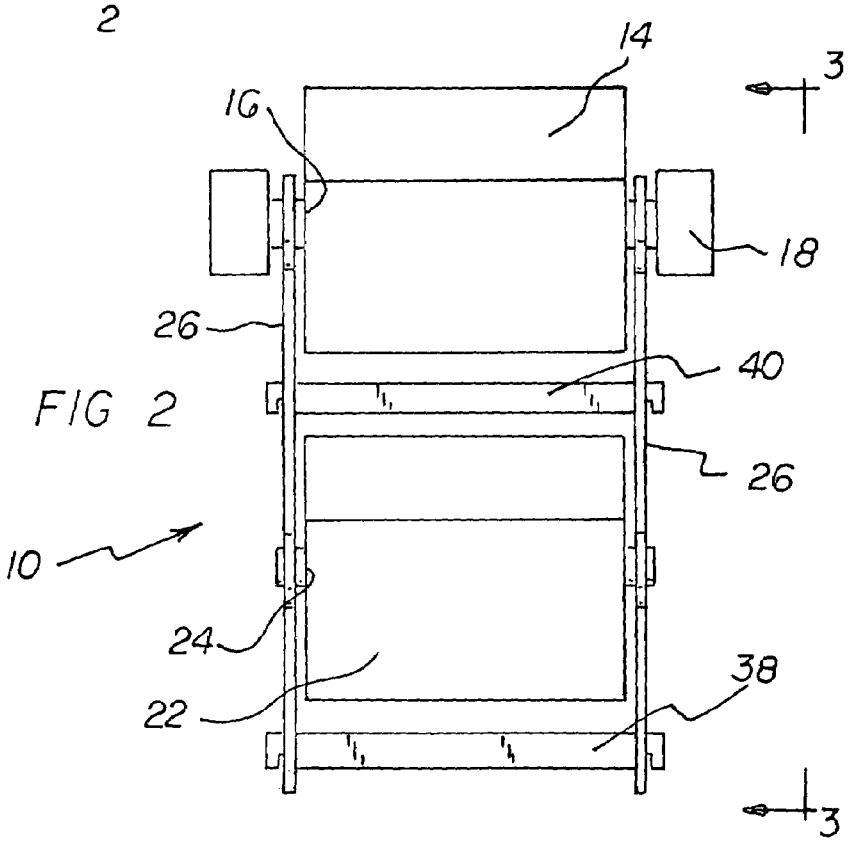
FIG. 2 is a front elevational view of the system shown in FIG. 1 taken along line 2—2 of FIG. 1.
Figure 3:
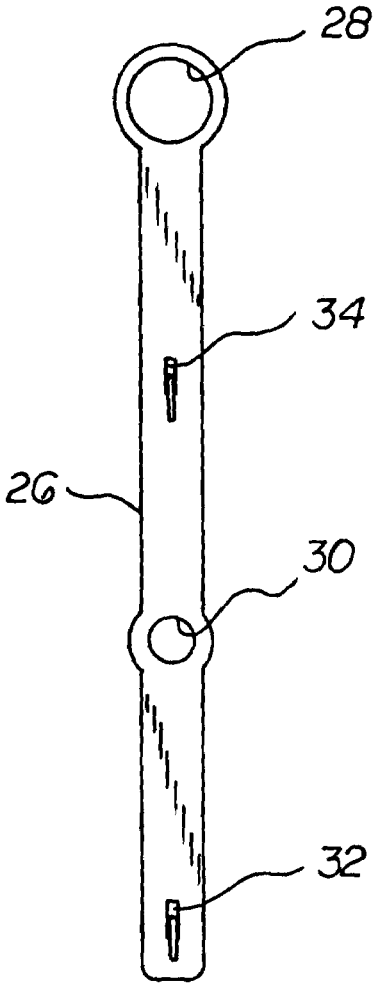
FIG. 3 is front elevational view of one secondary spindle support holder shown in the prior Figures.
Figure 4:
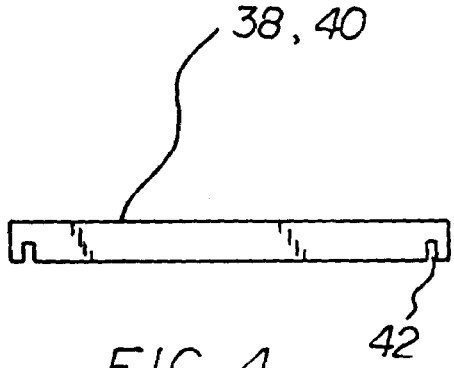
FIG. 4 is a front elevational view of one of the cross bars shown in FIGS. 1 and 2.
Figure 5:
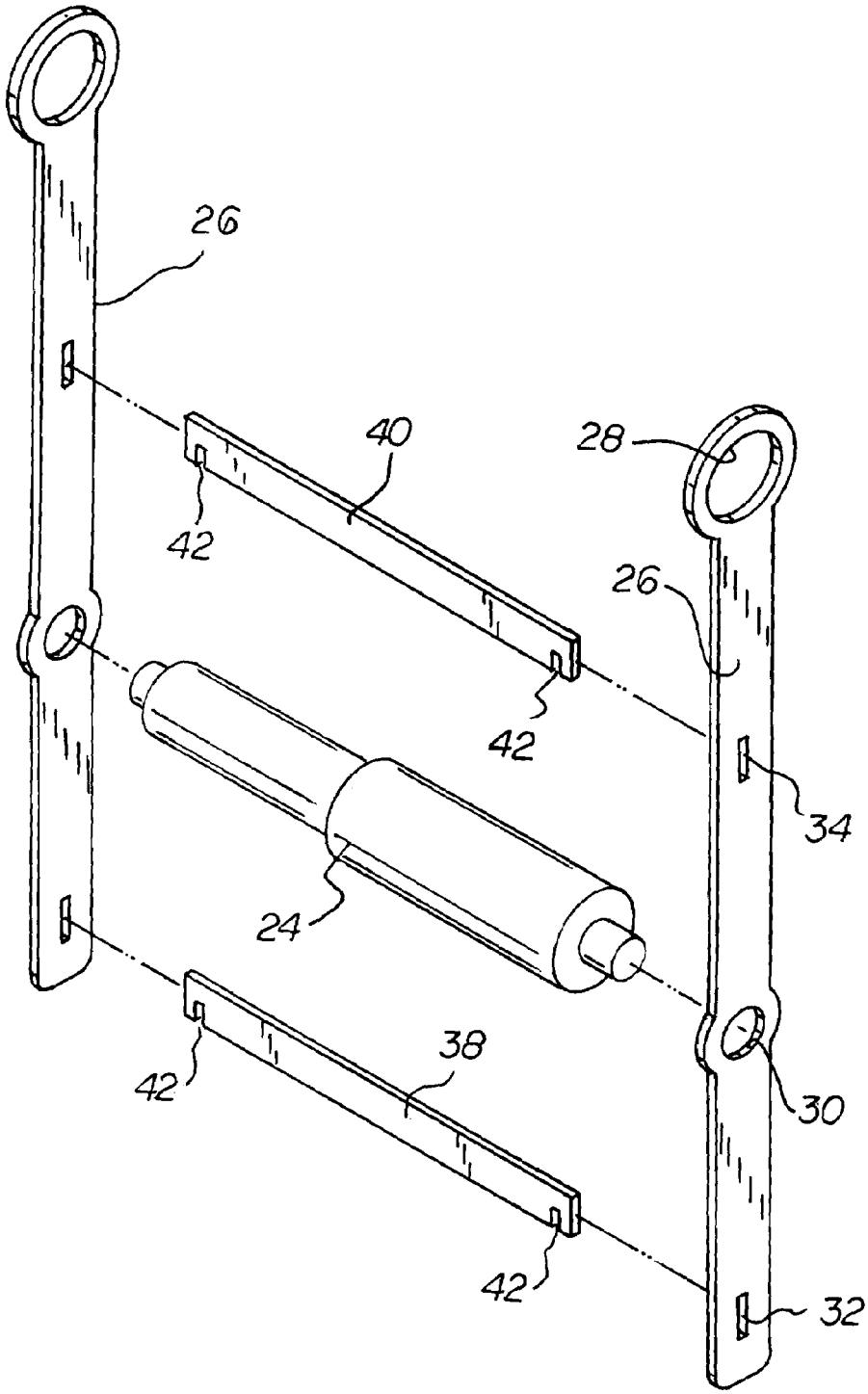
FIG. 5 is an exploded perspective view of the system shown in FIGS. 1 and 2, but illustrated independent of the primary roll spindle and support.

With reference now to the drawings, and in particular to FIG. 1 thereof, the preferred embodiment of the new and improved dual toilet paper holder system embodying the principles and concepts of the present invention and generally designated by the reference numeral 10 will be described.

The present invention, the dual toilet paper holder system 10 is comprised of a plurality of components. Such components in their broadest context include a pair of secondary spindle support holders and a pair of cross bars.

The dual toilet paper holder system 10 of the present invention is for supporting a secondary roll 22 of toilet paper. The supporting is done by a primary spindle 16 supported on a primary spindle support 18 while holding a primary roll 14 of toilet paper.

A secondary spindle 24 is provided for supporting a secondary roll 22 of toilet paper parallel with, but spaced beneath, a primary spindle 16 and primary toilet paper roll 14. The secondary spindle is axially adjustable to allow convenient coupling and uncoupling with respect to the system for mounting of a new roll of toilet paper.

Next provided is a pair of secondary spindle support holders 26. Each of the support holders has an upper end with a large aperture 28 adapted to receive there through a primary spindle 16. Each of the support holders has an intermediate aperture 30 of a reduced size adapted to receive and support a secondary roll 22 of toilet paper. Each of the support holders has a lower slot 32 beneath the intermediate aperture and an intermediate slot 34 between the upper and intermediate apertures.

A pair of cross bars 38, 40 is provided next. Included in the pair of cross bars is a lower cross bar 38 with opposed ends formed with inverted U-shaped recesses 42 received in the lower slot of the support holders. The cross bars also include an intermediate cross bar 40. The intermediate cross bar has inverted U-shaped recesses 42 received in the intermediate slots of the support holders. The support holders are spaced a fixed distance below the secondary spindle by the lower cross bar in association with the lower apertures and the support holders are spaced a fixed distance above the secondary spindle by the intermediate cross bar in association with the lower apertures. The support holders and cross bars are fabricated of an essentially rigid plastic material.

The present invention, the dual toilet paper holder system, was conceived to reduce the problem of being "out of toilet paper" at the most inappropriate times, in your own home or particularly in someone else's home.

It is a total embarrassment to be "caught short" while attending to human needs. The chances of being inconvenienced or embarrassed are greatly reduced when two rolls of toilet paper, toilet tissue, are in sight.

The dual toilet paper holder system of the present invention is a kit which includes a pair of secondary spindle support holders adapted to be supported by a primary spindle and a pair of cross bars removably couplable to the support holders and, optionally, a secondary spindle for supporting a secondary roll of toilet paper. The pair of secondary spindle support holders and the pair of cross bars may be purchased as a kit of separate pieces and connected and locked together just once.

The dual toilet paper holder system of the present invention may be mounted on a wall support as shown or on a standing receptacle.

Lastly, the dual toilet paper holder system of the present invention is preferably made of a generally rigid plastic and fabricated by injection molding methods so as to be cost efficient to a mass market. The plastic material may be made of a decorative color to suit the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dual toilet paper holder system comprising, in combination:

a primary roll of toilet paper;

a primary spindle supporting the primary roll of toilet paper;

a secondary roll of toilet paper;

a secondary spindle supporting said secondary roll of toilet paper parallel with, but spaced beneath, said primary spindle and primary toilet paper roll, said secondary spindle being axially adjustable to allow coupling and uncoupling with respect to the system;

a pair of secondary spindle support holders, each of the support holders having an upper end with a large circular aperture adapted to receive there through primary spindle, each of the support holders having an intermediate circular aperture of a reduced size adapted to receive and support secondary roll of toilet paper, each of the support holders having a lower slot beneath the intermediate aperture and an intermediate slot between the upper and intermediate apertures; and a pair of cross bars including a lower cross bar with opposed ends formed with inverted U-shaped recesses removably received in the lower slot of the support holders, the cross bars also including an intermediate cross bar having inverted U-shaped recesses removably received in the intermediate slots of the support holders whereby the support holders are spaced a fixed distance below secondary spindle by the lower cross bar in association with the lower apertures and whereby the support holders are spaced a fixed distance above secondary spindle by the intermediate cross bar in association with the lower apertures, the support holders and cross bars being fabricated of an essentially rigid plastic material.

* * * * *